US009161593B2

(12) United States Patent
Larson et al.

(10) Patent No.: US 9,161,593 B2
(45) Date of Patent: Oct. 20, 2015

(54) HEEL TRACTION AID AND METHOD OF MANUFACTURE THEREFOR

(75) Inventors: Jon C. Larson, Grand Forks, ND (US); Van B. Larson, Grand Forks, ND (US)

(73) Assignee: Sure Foot Corporation, Grand Forks, ND (US)

( * ) Notice: Subject to any disclaimer, the term of this patent is extended or adjusted under 35 U.S.C. 154(b) by 721 days.

(21) Appl. No.: 13/212,007

(22) Filed: Aug. 17, 2011

(65) Prior Publication Data

US 2013/0042503 A1 Feb. 21, 2013

(51) Int. Cl.

| | |
|---|---|
| ***A43B 23/30*** | (2006.01) |
| ***A43B 3/18*** | (2006.01) |
| ***A43C 15/12*** | (2006.01) |
| ***A43C 15/06*** | (2006.01) |
| ***A43C 15/14*** | (2006.01) |

(52) U.S. Cl.

CPC . *A43C 15/12* (2013.01); *A43B 3/18* (2013.01); *A43B 23/30* (2013.01); *A43C 15/066* (2013.01); *A43C 15/14* (2013.01)

(58) Field of Classification Search

CPC ..... A43B 5/18; A43B 13/28; A43B 23/30; A43B 3/16; A43B 3/18

USPC ..... 36/7.1 R, 7.5, 7.6, 59 R, 61, 62, 100, 36/101, 15

See application file for complete search history.

(56) References Cited

U.S. PATENT DOCUMENTS

| | | | | |
|---|---|---|---|---|
| 183,949 A | | 10/1876 | Loewenthal | |
| 1,117,019 A | | 11/1914 | Foltz | |
| 1,195,866 A | * | 8/1916 | Stephan | 36/7.6 |
| 1,458,497 A | * | 6/1923 | Perkins | 36/7.6 |
| 1,552,946 A | * | 9/1925 | Perkins | 36/7.6 |
| 1,564,307 A | * | 12/1925 | Antonio Fereo et al. | 36/7.6 |
| 1,596,832 A | * | 8/1926 | Heinemann | 36/62 |
| 1,757,919 A | * | 5/1930 | Ostrander | 36/62 |
| 1,869,988 A | | 8/1932 | Vellner | |
| 2,128,134 A | | 8/1938 | Giusto | |
| 2,170,691 A | * | 8/1939 | Mutter | 36/7.6 |
| 2,189,884 A | * | 2/1940 | Dow | 36/7.6 |
| 2,313,316 A | * | 3/1943 | Block | 36/62 |
| 2,422,335 A | * | 6/1947 | Bozek | 36/61 |
| 2,668,373 A | | 2/1954 | Russo | |
| 2,932,096 A | | 4/1960 | Tavormina | |
| 3,021,617 A | | 2/1962 | Koch | |
| 3,095,657 A | * | 7/1963 | Fradette | 36/7.6 |

(Continued)

FOREIGN PATENT DOCUMENTS

| | | |
|---|---|---|
| CA | 1112865 | 11/1981 |

*Primary Examiner* — Marie Bays

(74) *Attorney, Agent, or Firm* — Robert D. Atkins; Patent Law Group;Atkins and Associates, P.C.

(57) ABSTRACT

A heel traction aid (HTA) includes a gripping pad and a traction device having an upper surface, where the gripping pad includes a receiving bore penetrating the gripping pad and a raised ring encircling the receiving bore. The traction device is disposed in receiving bore such that the upper surface is disposed below the raised ring. The HTA includes a heel cup attached to lateral edges of the gripping pad, a first strap attached to the heel cup and including a first hook, and a second strap attached to the heel cup and including first holes. The first and second straps have elasticity sufficient to maintain tension when a heel of a shoe or foot is positioned in a concavity formed by the gripping pad and the contoured heel cup and when the first hook is engaged with one of the first holes of the second strap.

21 Claims, 8 Drawing Sheets

(56) References Cited

U.S. PATENT DOCUMENTS

| | | | | | |
|---|---|---|---|---|---|
| 3,176,416 | A | * | 4/1965 | Seegert | 36/7.1 R |
| 3,229,389 | A | * | 1/1966 | Adams | 36/7.6 |
| 3,616,552 | A | | 11/1971 | Kniffin | |
| 3,713,233 | A | * | 1/1973 | Hunnicutt | 36/61 |
| 4,005,533 | A | | 2/1977 | Anderson et al. | |
| 4,299,037 | A | | 11/1981 | Carey | |
| 5,315,768 | A | | 5/1994 | Pacheco | |
| 5,463,823 | A | | 11/1995 | Bell et al. | |
| 5,600,901 | A | * | 2/1997 | Leonor | 36/7.1 R |
| 5,689,901 | A | | 11/1997 | Bell et al. | |
| 5,694,704 | A | | 12/1997 | Kasbrick | |
| 5,813,143 | A | | 9/1998 | Bell et al. | |
| 5,836,090 | A | | 11/1998 | Smith | |
| 5,921,005 | A | | 7/1999 | Bell et al. | |
| 6,154,982 | A | * | 12/2000 | Bell et al. | 36/7.6 |
| 6,742,286 | B2 | | 6/2004 | Giovale | |
| 6,775,927 | B2 | | 8/2004 | Glicksman | |
| 6,836,977 | B2 | | 1/2005 | Larson et al. | |
| 7,089,688 | B2 | | 8/2006 | Giovale | |
| 7,555,850 | B2 | * | 7/2009 | Park | 36/62 |
| 2003/0052473 | A1 | | 3/2003 | Perkins et al. | |
| 2003/0145489 | A1 | | 8/2003 | Major | |
| 2004/0045190 | A1 | | 3/2004 | Washburn et al. | |
| 2004/0049943 | A1 | * | 3/2004 | Glicksman | 36/7.1 R |
| 2005/0022430 | A1 | * | 2/2005 | Terry | 36/72 R |
| 2005/0198860 | A1 | * | 9/2005 | Larson et al. | 36/7.6 |
| 2007/0113424 | A1 | | 5/2007 | Bell | |
| 2007/0163148 | A1 | * | 7/2007 | Laporte | 36/61 |
| 2009/0049711 | A1 | * | 2/2009 | Finch | 36/7.6 |
| 2010/0088929 | A1 | * | 4/2010 | Comoli | 36/103 |

* cited by examiner

HEEL TRACTION AID AND METHOD OF MANUFACTURE THEREFOR

FIELD OF THE INVENTION

The present invention relates in general to shoe apparel and, more particularly, to an anti-slip Heel Traction Aid (HTA) and to a method of manufacturing an anti-slip Heel Traction Aid.

BACKGROUND OF THE INVENTION

Shoes, including athletic shoes, work boots, dress shoes, ski boots, overshoes, and all manner of footwear, provide poor traction on many surfaces, including slippery, icy, and wet surfaces. The difficulties of moving across a slippery surface, including walking, running and jogging, result in aggravation and injury. Slips, falls and resultant injuries are typically caused by a lack of good footing.

Even if a person does not actually fall, the need to walk slowly or with small steps over a slippery surface is inconvenient, slows movement, and is a distraction that interferes with a person's ability to be aware of their surroundings and be alert to non-slip hazards.

The problems of walking on slippery surfaces interfere with business that requires outdoor work to be done when conditions are icy. Postal and parcel delivery, for instance, is hampered, as well as baggage handling, road repair, ambulance and emergency work, police work, and any outdoor work that cannot be stopped for inclement weather.

Runners, joggers and persons that exercise outdoors are hampered by the loss of traction on slippery surfaces. Even if outdoor surfaces are slightly slippery, a jogger must take smaller strides to avoid slipping. Activities that require movement faster than a slow walk are greatly hindered in inclement conditions by a lack of suitable footwear.

Further, even the knowledge that roads and sidewalks are slippery can be detrimental. The knowledge that outdoor walking conditions are hazardous may discourage persons from engaging in normal activities. For instance, a person is more likely to choose not to walk to a store, to take a pet for a walk, or otherwise leave home if the person knows that walking conditions are slippery and may lead to injury.

The problem of slippery surfaces is especially acute for the elderly or persons with disabilities that interfere with a standard gait. Many elderly persons experience impediments to walking that make the elderly person more likely to slip and fall under normal conditions; and in climates where snow and ice persists through a significant portion of the winter, some elderly persons become essentially homebound. Similarly, a disability that causes an irregular gait may discourage a person from undertaking normal activities when outdoor walkways provide sub-par traction; for example, the loss of a leg may create an irregular gait that leads to added vulnerability to slipping.

Ideally, footwear that provides good traction in all weather would minimize the inconvenience of changing or removing shoes every time a person comes indoors. Further, a device that is versatile and works with many size shoes or foot-sizes is desirable so that a user, especially an organization that serves multiple persons, may stock a minimal number.

SUMMARY OF THE INVENTION

In one embodiment, the present invention is a heel traction aid (HTA) structured to provide increased traction to no more than a heel portion of a human foot or an item of footwear. The HTA comprises a gripping pad that is substantially flat, and the gripping pad includes a receiving bore that penetrates the gripping pad and a raised ring that encircles the receiving bore on a first surface of the gripping pad. The HTA further comprises a traction device having an upper surface and a spike protruding from the upper surface. The traction device is disposed in the receiving bore of the gripping pad such that the spike protrudes above the raised ring and such that the upper surface of the traction device is disposed below the raised ring. The HTA further comprises a contoured heel cup that is attached to a first lateral edge of the gripping pad and a second lateral edge of the gripping pad. The second lateral edge of the gripping pad is opposite the first lateral edge of the gripping pad. The HTA further comprises a first strap having a proximal end that is attached to the contoured heel cup at a first location above the first lateral edge of the gripping pad. The first strap further includes a first hook disposed at a distal end of the first strap. The HTA further comprises a second strap having a proximal end that is attached to the contoured heel cup at a second location above the second lateral edge of the gripping pad. The second strap further includes first holes disposed uniformly along a length of the second strap. The first and second straps have an elasticity sufficient to maintain tension when the heel portion is positioned in a concavity formed by the gripping pad and the contoured heel cup and when the hook of the first strap is engaged with one of the first holes of the second strap.

In another embodiment, the present invention is a heel traction aid (HTA) structured to provide increased traction to a heel portion of a human foot or an item of footwear. The HTA comprises a gripping pad including a receiving bore that penetrates the gripping pad and a raised ring that encircles the receiving bore on a first surface of the gripping pad. The HTA further comprises a traction device having an upper surface and a spike protruding from the upper surface. The traction device is disposed in the receiving bore of the gripping pad such that the upper surface of the traction device is disposed below the raised ring. The HTA further comprises a contoured heel cup attached to lateral edges of the gripping pad, where the lateral edges are opposite each other. The HTA further comprises a first strap including a proximal end that is attached to the contoured heel cup and a first hook disposed at a distal end of the first strap. The HTA further comprises a second strap including a proximal end that is attached to the contoured heel cup and first holes disposed along a length of the second strap. The first and second straps have an elasticity sufficient to maintain tension when the heel portion is positioned in a concavity formed by the gripping pad and the contoured heel cup and when the first hook is engaged with one of the first holes of the second strap.

In another embodiment, the present invention is a heel traction aid (HTA) comprising a gripping pad including a receiving bore that penetrates the gripping pad and a raised ring that encircles the receiving bore, and a traction device having an upper surface. The traction device is disposed in the receiving bore such that the upper surface of the traction device is disposed below the raised ring. The HTA further comprises a contoured heel cup attached to lateral edges of the gripping pad, a first strap attached to the contoured heel cup and including a first hook disposed at a distal end of the first strap, and a second strap attached to the contoured heel cup and including first holes disposed along the second strap. The first and second straps have an elasticity sufficient to maintain tension when a heel of a shoe or foot is positioned in a concavity formed by the gripping pad and the contoured heel cup and when the first hook is engaged with one of the first holes of the second strap.

In another embodiment, the present invention is a method of making a heel traction aid comprising providing a gripping pad including a receiving bore that penetrates the gripping pad and a raised ring that encircles the receiving bore. The method further comprises disposing a traction device having an upper surface in the receiving bore such that the upper surface of the traction device is disposed below the raised ring, providing a contoured heel cup attached to lateral edges of the gripping pad, and providing a first strap attached to the contoured heel cup. The first strap includes a first hook disposed at a distal end of the first strap. The method further comprises providing a second strap attached to the contoured heel cup and including first holes disposed along the second strap. The first and second straps have an elasticity sufficient to maintain tension when a heel of a shoe or foot is positioned in a concavity formed by the gripping pad and the contoured heel cup and when the first hook is engaged with one of the first holes of the second strap.

DETAILED DESCRIPTION OF THE DRAWINGS

Figure 1A:
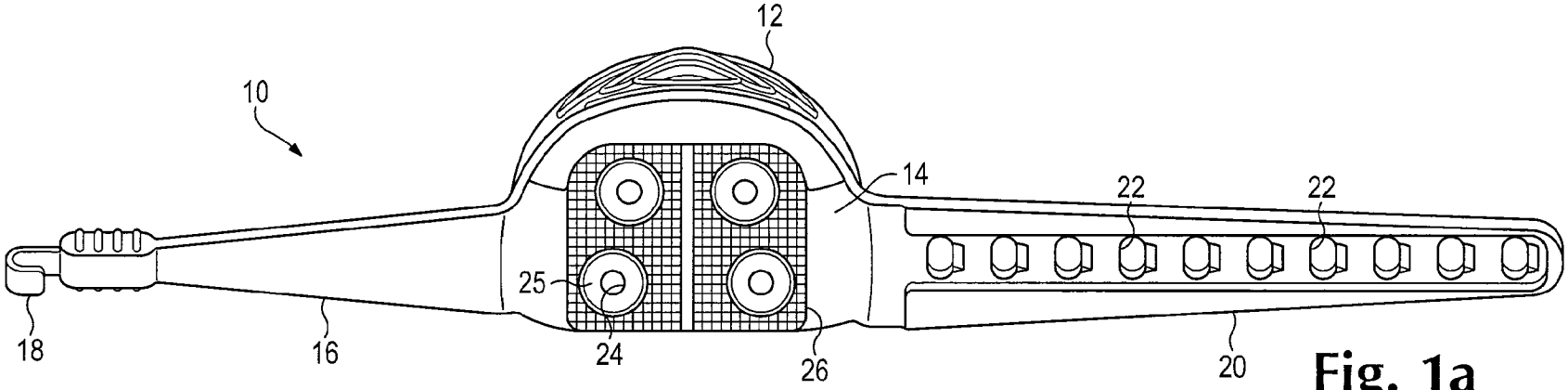
FIGS. 1*a*, 1*b*, 1*c*, and 1*d* are diagrams that illustrate top, bottom, and several perspective views of an HTA according to an example embodiment.

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings. In the drawings, like reference numerals refer to like elements.

For purposes of this disclosure, a HTA is defined as a half-sandal having one or more traction-aiding elements, wherein the half-sandal is structured to be removably attached to a human foot or an item of footwear such that the one or more traction-aiding elements are disposed entirely beneath a heel portion of the human foot or the footwear. Items of footwear may include, but are not limited to, a boot, a sandal, a slipper, or a shoe of any type. An HTA can easily slip on and off a human foot or an item of footwear and provides excellent grip and traction on slippery surfaces. The improvement in grip and traction results in greater safety, efficiency, and confidence for a person moving across a surface. Walking and/or jogging are safer and the wearer of the HTA may move with an increased stride length that is faster and more comfortable. Use of a HTA by a wearer helps to solve the difficulties previously described.

FIGS. 1*a*, 1*b*, 1*c*, and 1*d* illustrate top, bottom, and two perspective views, respectively, of HTA 10 according to an example embodiment. Referring to FIGS. 1*a*-1*d*, a material of HTA 10 can be a durable elastic material that is tough, lightweight and flexible even in temperatures below 0° F. The term "elastic material" as described includes natural and synthetic polymers, including rubbers and reinforced rubbers, and other suitable materials. HTA 10 can be constructed using amorphous and crystalline thermoplastic resins. HTA 10 can be constructed using an injection molding process where hot, molten polymer is injected into a cold mold. A screw apparatus can be used to inject the polymer into the mold. After HTA 10 cools and hardens, the mold is opened and HTA 10 is ejected from the mold. Any resulting flashing is then removed from HTA 10. HTA 10 can be constructed by using an injection molding technique that extrudes material over an existing core plate in the mold to provide a unitary construction. In alternative embodiments, it is contemplated that HTA 10 could be manufactured using a compression molding process, a die-cutting process, a stamping process, or a water jet cutting process.

The material of HTA 10 can be formulated to allow for a certain amount of stretch, while maintaining durability and light weight. By allowing for stretch, a relatively small number of HTA sizes can be provided to accommodate a relatively larger number of shoe sizes. A small/medium size HTA 10 can easily accommodate a range of shoe sizes from small women's shoes to medium sized men's shoes. Similarly, a large/extra large size HTA 10 can easily accommodate a range of shoe sizes from medium sized men's shoes to much larger sized men's shoes. Essentially, two sizes of HTA 10 can be constructed to cover the broad range of both men's and women's shoe sizes.

HTA 10 includes a contoured heel cradle or heel cup 12 and a gripping pad 14. Heel cup 12 can be configured to have a concave surface that is shaped to approximately correspond to an outer contour of a heel portion of a human foot or an item of footwear, while gripping pad 14 can be configured to have a flat surface that is shaped to approximately correspond to an underside of a heel portion of a human foot or an item of footwear. Therefore, a concavity formed by heel cup 12 and gripping pad 14 can closely correspond to an overall shape of an outer contour of a heel portion of a human foot or an item of footwear.

As illustrated, gripping pad 14 is designed in a substantially square or rectangular shape. Alternatively, a shape of gripping pad 14 may be substantially circular, oval, ring, or egg shaped to more closely approximate a surface of a heel portion of a shoe. For example, a smaller, circular gripping pad may be more appropriate for a woman's dress shoe than a rectangular shape.

HTA 10 further includes a first strap 16 having a proximal end that is attached to contoured heel cup 12 at a first location above a junction between contoured heel cup 12 and gripping pad 14. First strap 16 further includes a hook 18 disposed at a distal end of first strap 16.

HTA 10 further includes a second strap 20 having a proximal end that is attached to contoured heel cup 12 at a second location above another junction between contoured heel cup 12 and gripping pad 14. Second strap 20 further includes a series of holes 22 that are disposed uniformly along a length of second strap 20.

Figure 3:
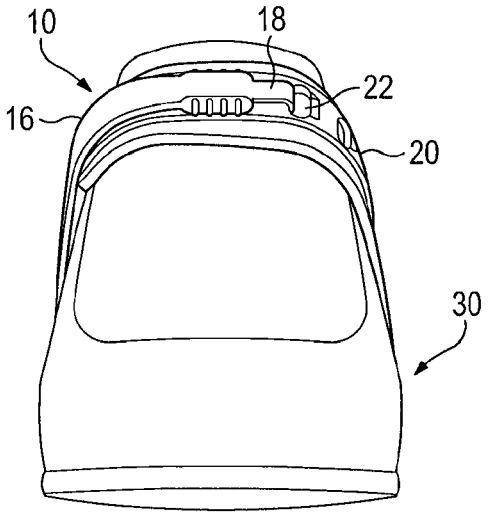
FIG. 3 is a diagram that illustrates a front view of a shoe having the HTA of FIGS. 1*a*-1*d* secured to its heel.

As shown, holes 22 have a lozenge shape, although other geometric shapes can be used. Other possible geometric shapes for the holes 22 can include, but are not limited to, square, rectangular, or oval. For purposes of this disclosure, a lozenge shape is defined as a rectangular shape that is modified such that the shorter sides of the rectangle are semicircular. Preferably, holes 22 are oriented along second strap 20 such that a flat portion of hook 18 is in contact with a straight portion of lozenge-shaped hole 22 when hook 18 is engaged in the hole 22. This preferred relationship between hook 18 and hole 22 is illustrated in FIG. 3.

HTA 10 further includes a number of bores 24 that penetrate through a thickness of gripping pad 14 in desired locations. Bores 24 have a circular shape. Other embodiments may have fewer bores or more bores, which may be arranged in any desired pattern. As will be explained below, bores 24 are designed to retain replaceable traction aiding devices (e.g., spikes), further increasing traction and grip provided by HTA 10.

As illustrated, HTA 10 further includes smooth areas 25 that are disposed on an upper surface of gripping pad 14. Each smooth area 25 has a circular shape and is preferably, but not necessarily, disposed such that a bore 24 is located at a center of each smooth area 25.

HTA 10 further includes a textured area 26 that is disposed on an upper surface of gripping pad 14. Smooth areas 25 are disposed within textured area 26. Textured area 26 is a region on an upper surface of gripping pad 14 that has been provided a roughened or textured surface. Textured area 26 is adapted to contact an underside of a human heel or an underside of a heel on an item of footwear in order to help prevent slipping from occurring between gripping pad 14 and an underside of a human heel or an underside of a heel on an item of footwear. In some embodiments, textured area 26 of gripping pad 14 may be formed by creating corresponding textured areas in a surface of a mold that is used to form HTA 10.

As illustrated, HTA 10 further includes smooth areas 27 that are disposed on a lower surface of gripping pad 14. Each smooth area 27 has a circular shape and is preferably, but not necessarily, disposed such that a bore 24 is located at a center of each smooth area 27.

HTA 10 further includes traction aiding elements, such as ridges 28, which are also disposed on a lower surface of gripping pad 14. Smooth areas 27 are surrounded by ridges 28. Ridges 28 protrude from a lower surface of gripping pad 14, and are arranged in multiple rows across a length of gripping pad 14. Each row of ridges 28 is arranged such that each ridge 28 in a row "points" in the same direction. Rows of ridges 28 are further arranged such that ridges 28 in adjacent rows "point" in opposite directions. Rows of ridges 28 are further arranged such that each row of ridges 28 has a saw-tooth profile in a direction taken along a length of each row of ridges 28.

Figure 1B:
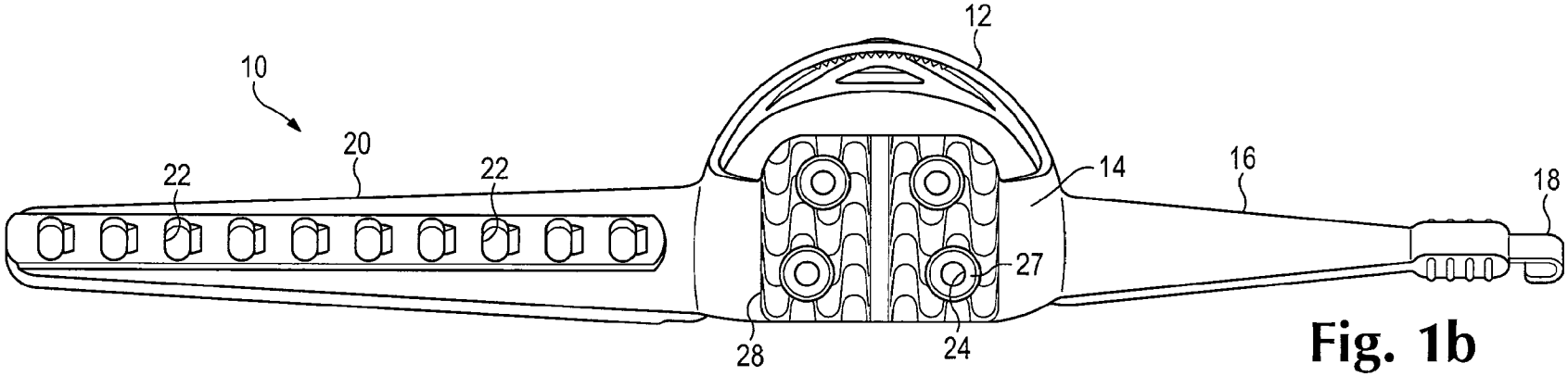
Figure 1C:
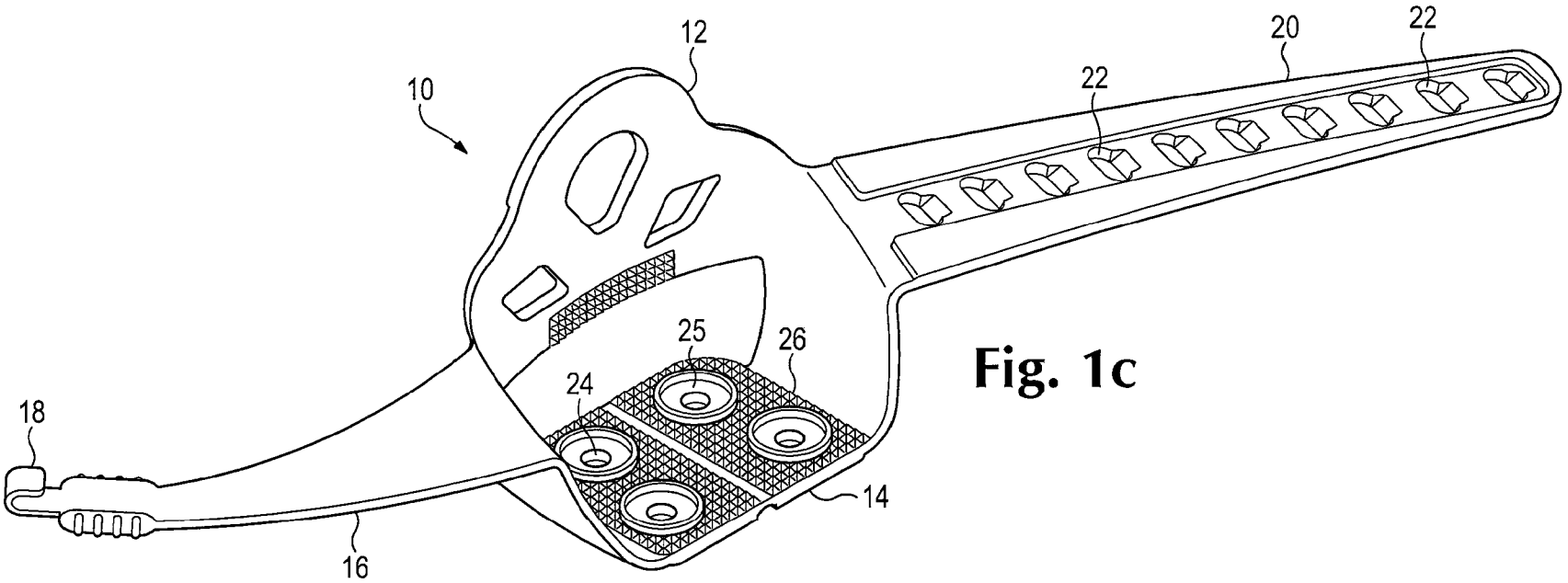
Figure 1D:
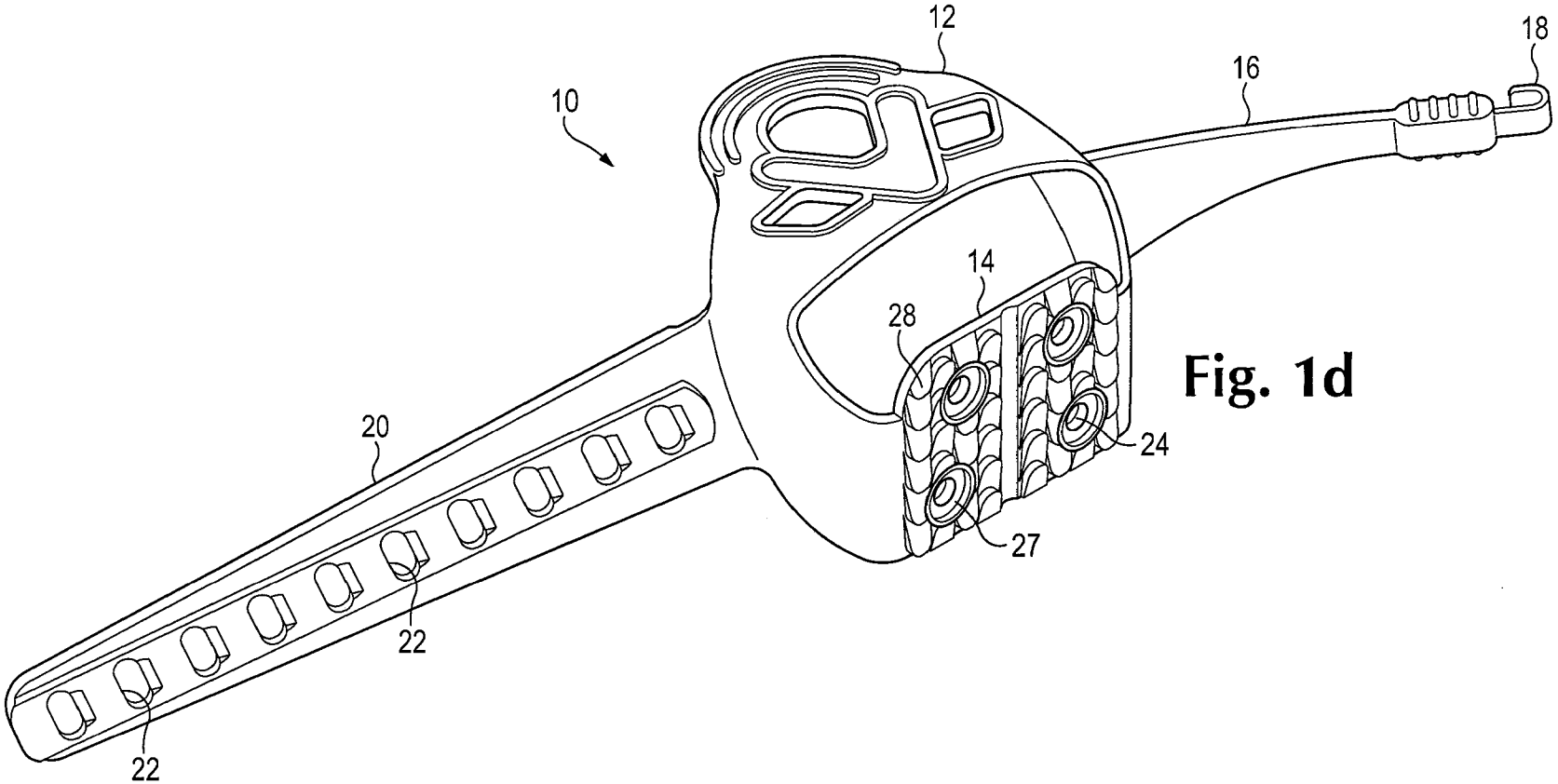

An arrangement of ridges 28 as illustrated in FIGS. 1*b* and 1*d* provides increased traction and surefootedness to a person wearing HTA 10 on a foot or on an item of footwear. Like textured areas 26 on an upper surface of gripping pad 14, ridges 28 may be formed by creating corresponding depressions in a surface of a mold that is used to form HTA 10.

In other example embodiments, traction aiding elements may be shaped differently, e.g., ridges 28 may be shaped as closed geometric figures such as a circles, ovals, squares, rectangles, trapezoids, triangles, hexagons, etc. In still other example embodiments, traction aiding elements such as pillars or spikes may be used in addition to or instead of ridges 28.

Figure 2A:
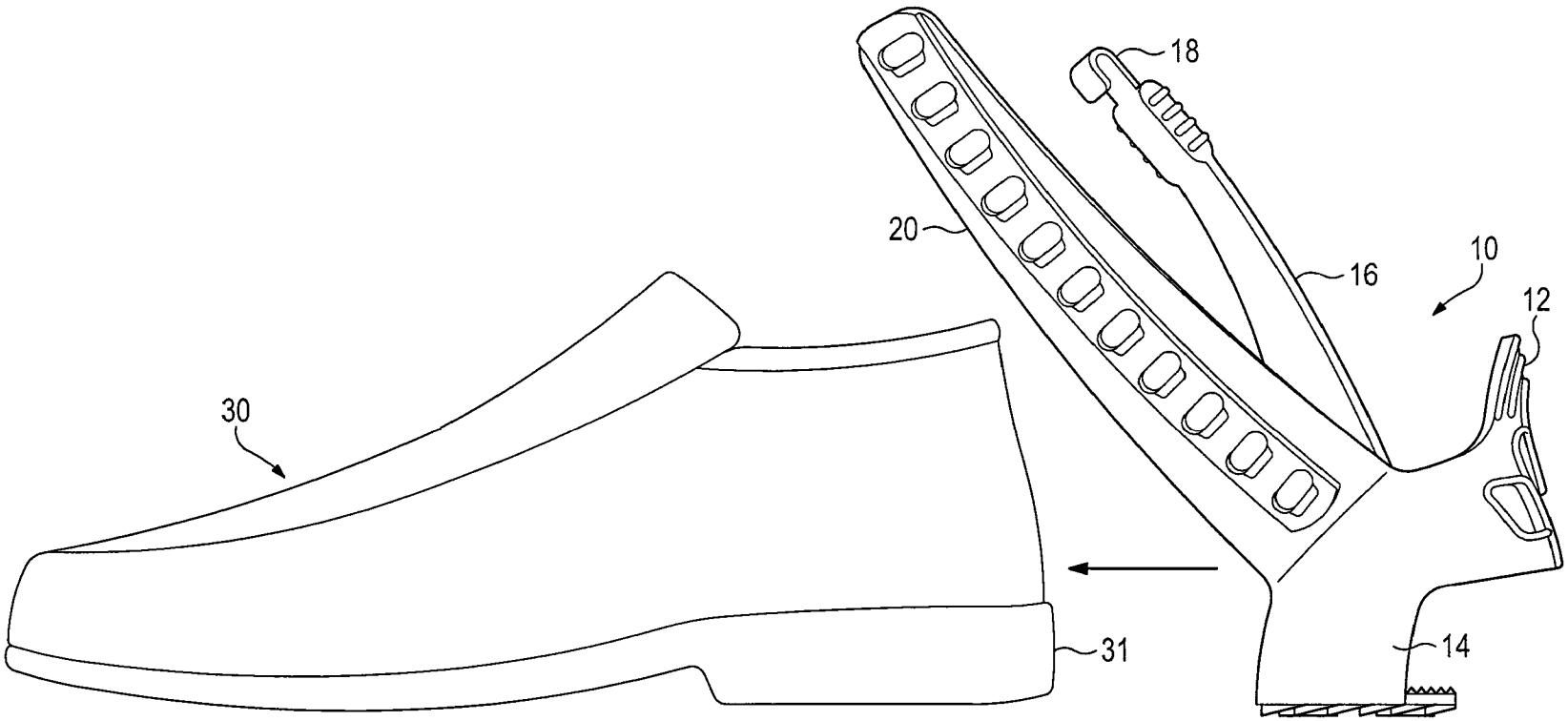
FIGS. 2*a*, 2*b*, and 2*c* are diagrams that illustrate a process of securing the HTA of FIGS. 1*a*-1*d* to a heel of a shoe.
Figure 2B:
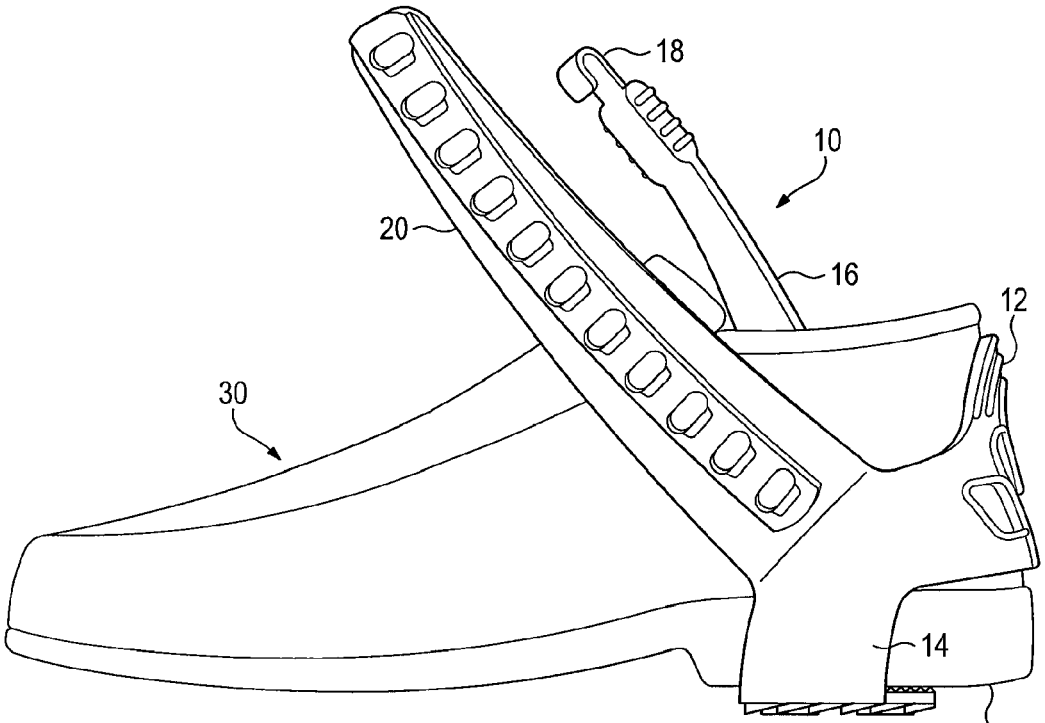
Figure 2C:
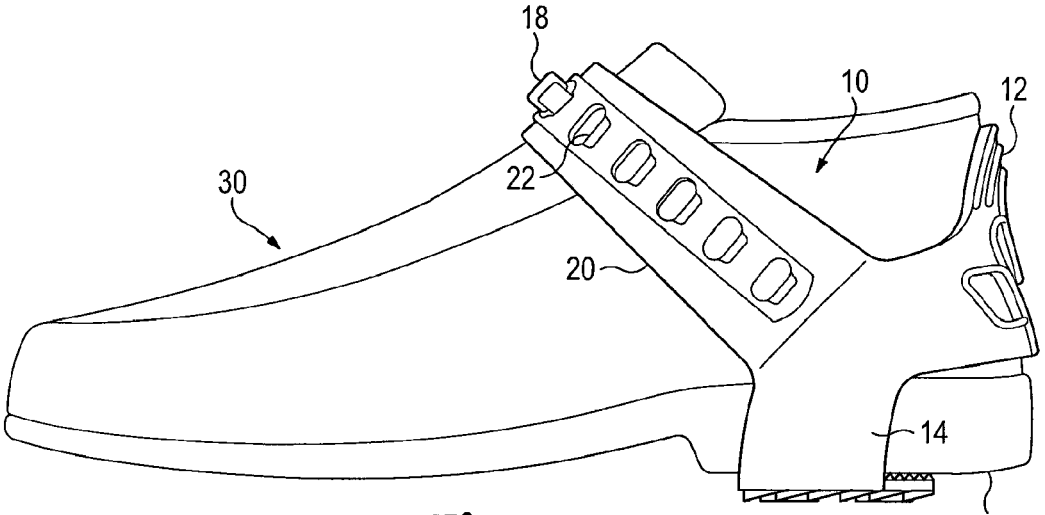

FIGS. 2*a*, 2*b*, and 2*c* are diagrams that illustrate a process of securing HTA 10 to heel 31 of shoe 30. Initially, as shown in FIG. 2*a*, HTA 10 is arranged such that flexible first strap 16 and flexible second strap 20 are drawn away from each other, thereby exposing an "opened" heel cup 12 of HTA 10.

After that, as shown in FIG. 2*b*, shoe 30 and HTA 10 are brought together and positioned relative to each other such that a heel 31 of shoe 30 is placed within a space defined by heel cup 12 and gripping pad 14. Next, first and second straps 16, 20 are brought together over a top of shoe 30.

Heel cup 12, gripping pad 14, first strap 16, and second strap 20 can have a certain amount of associated elasticity. For example, first strap 16 and second strap 20 can be stretched by applying tension. Upon release of tension, first and second straps 16, 20 can return to their original shape.

As a result of the elasticity of first strap 16 and second strap 20 that was described above, first strap 16 and/or second strap 20 can be stretched so that hook 18, which is disposed at a distal end of first strap 16, can be inserted into a desired hole 22 in second strap 20. The action of stretching first and second straps 16, 20 is typically, but not always, performed by a person who is wearing shoe 30 and is attempting to fasten HTA 10 around a heel 31 of shoe 30.

Securing hook 18 into a desired hole 22 of second strap 20 while first strap 16 and/or second strap 20 are extended prevents first strap 16 and/or second strap 20 from returning to their original shape, and thus provides tension that securely holds HTA 10 in place over a heel portion of shoe 30. Once HTA 10 is securely fastened to a heel 31 of shoe 30, a wearer can feel more confident when engaged in winter activities, such as walking quickly on a snowy or icy sidewalk.

Placing hook 18 into hole 22 to secure HTA 10 to a heel 31 of shoe 30 is but one method of securing HTA 10. It is contemplated that many different varieties of fasteners could be used. For example, a first half of a heavy duty snap closure could be provided at a distal end of first strap 16, and a series of second halves of the heavy duty snap closure could be provided along second strap 20. Much like the hook 18 and hole 22 combination that was illustrated, the snap closures would effectively function to secure the HTA 10 to the shoe 30. As another example, a series of small pegs could be disposed on first strap 16 and arranged to face outward when the HTA 10 is being worn. A corresponding series of reinforced holes could be disposed on second strap 20, and HTA 10 could be secured by placing one or more holes on second strap over and around a corresponding peg on first strap 16. As another example, a hook and loop fastener such as Velcro® might be used. The examples provided above are not an exhaustive list, and there are no doubt other types of existing fasteners that could be used to secure first strap 16 to second strap 20. Embodiments are intended to cover all such method of securing first strap 16 to second strap 20.

Figure 4:
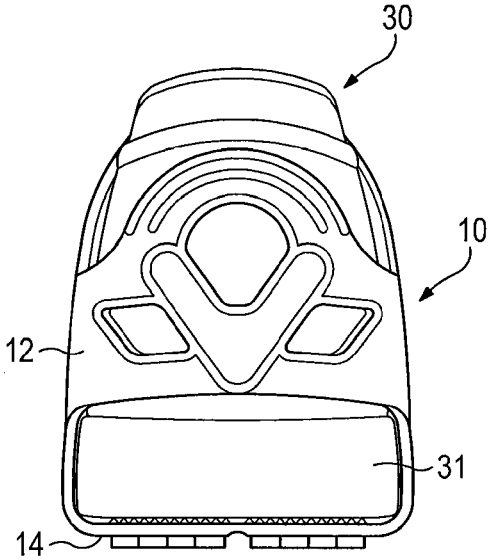
FIG. 4 is a diagram that illustrates a back view of a shoe having the HTA of FIGS. 1*a*-1*d* secured to its heel.
Figure 5:
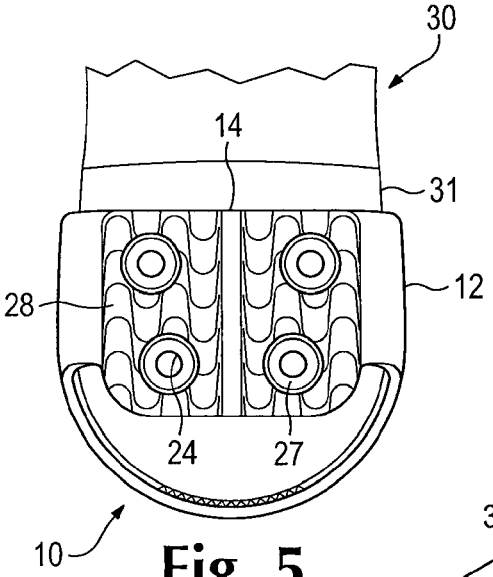
FIG. 5 is a diagram that illustrates a bottom view of a shoe having the HTA of FIGS. 1*a*-1*d* secured to its heel.

FIGS. 3, 4, and 5, following, depict HTA 10 in a secured position over heel 31 of shoe 30. FIG. 3 illustrates a front view of HTA 10 secured to heel 31 of shoe 30. FIG. 4 illustrates a back view of HTA 10 secured to heel 31 of shoe 30. FIG. 5 illustrates a bottom view of HTA 10 secured to heel 31 of shoe 30.

Turning to FIGS. 3 and 5, first and second straps 16, 20 do not extend past a vamp portion of shoe 30, and gripping pad 14 does not extend forward from a heel 31 of shoe 30. Limiting gripping pad 14 to heel 31 of shoe 30 enables a person wearing HTA 10 to enjoy the benefits of added traction by adjusting the stride or gait that is used.

For example, a runner attempting to run on a jogging path that possessed patchy areas of ice and snow could easily run on balls of her feet if she encountered a clear or dry area without having to place gripping pad 14 in contact with the ground. If, however, a snowy or icy area was encountered the runner could alter her stride slightly to cause her heel to strike the ground, causing gripping pad 14 and associated ridges 28 and/or traction devices to engage the slippery surface. The runner may also choose to slow down and use a walking gait, which would also result in gripping pad 14 contacting the ground.

Turning to FIG. 4, a back view of HTA 10 secured to heel 31 of shoe 30 is depicted. Again, heel 31 of shoe 30 lies within a concavity provided by contoured heel cup 12 and gripping pad 14. As described above, HTA 10 is secured in place by first and second straps 16, 20.

FIG. 5 depicts a bottom view of HTA 10 in a secured position over a heel 31 of shoe 30. Gripping pad 14 is arranged to fit over heel 31 such that ridges 28 are disposed downward to grip an underlying surface. Gripping pad 14 does not extend forward of heel 31, although this may not hold true for all embodiments. HTA 10 can be designed such that an overall form of gripping pad 14 does not generally change, even when gripping pad is secured in position over heel 31.

As shown in FIGS. 3 and 5, the bulk of stretch that occurs in HTA 10 is performed by first and second straps 16, 20. First and second straps 16, 20 stretch appropriately to accommodate the size of shoe 30, while a basic size and form of gripping pad 14 remains substantially unchanged. First strap 16 and second strap 20 appropriately stretch on both left and right sides to ensure that gripping pad 14 is centered properly. Because of the elasticity and deformability associated with first strap 16 and second strap 20, HTA 10 can take on a virtually flat, two-dimensional form when not in use. Having a virtually flat form is attractive for storage and packaging purposes, as a number of stored HTAs 10 can be placed in a relatively small storage space, and individual HTAs 10 can utilize relatively thin packaging.

HTA 10 can have greater thickness in critical areas. Other anti-slip overshoes have a thickness that is essentially uniform throughout. Having a uniform thickness may simplify mass production of prior art overshoes, but the durability of prior art overshoes is compromised. The longevity of HTA 10 can be improved by adding extra material thickness at key areas. For instance, gripping pad 14 can have thicker material than the heel cup 12. In addition, areas around traction devices 32 can be reinforced with additional material.

In some example embodiments, gripping pad 14 may incorporate additional materials or elements that are designed to reduce shock and/or to improve anti-fatigue properties when standing, walking, or running. These shock absorbing and/or anti-fatigue elements can include, but are not limited to, air chambers or internal springs.

As illustrated in FIGS. 3-5, a contoured design of heel cup 12 and gripping pad 14 allows for a proper amount of stretch and corresponding fitment in an appropriate direction, either from side to side, or from front to back of HTA 10. As illustrated in FIGS. 2-5, a design of HTA 10 can be well-suited for use with a man's shoe 30. However, it is contemplated that HTA 10 may be, either with slight modifications or without, equally well-suited for other types of footwear such as athletic shoes, casual shoes, boots, sandals, or even bare human feet.

Figure 6:
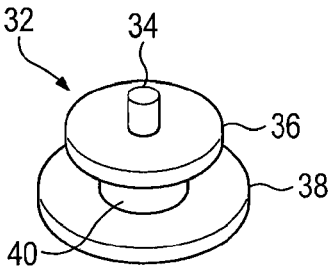
FIG. 6 is a diagram that illustrates a removable traction device suitable for use in conjunction with the HTA of FIGS. 1*a*-1*d;*
Figure 7:
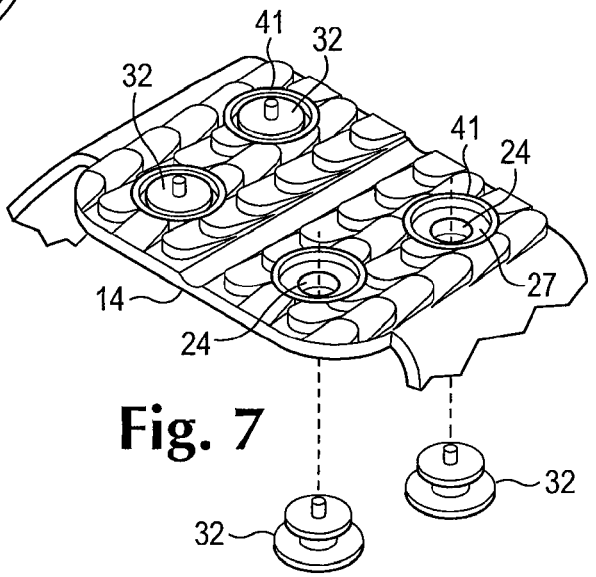
FIG. 7 is a partial exploded view diagram illustrating how the removable traction devices of FIG. 6 are inserted into a gripping pad of the HTA of FIGS. 1*a*-1*d;*

FIG. 6 illustrates an example of a removable or replaceable traction device 32 for use in HTA 10. FIG. 7 is an exploded view diagram illustrating how replaceable traction devices 32 may be inserted into gripping pad 14 of HTA 10 for increased traction. In alternative embodiments, traction devices 32 may be molded permanently into the gripping pad 14 of HTA 10.

As shown in FIGS. 6 and 7, HTA 10 can include multiple removable or replaceable traction devices 32 that help the wearer maintain grip and traction on a surface. Traction devices 32 can include any device which is intended to enhance traction, such as spikes 34. Spikes of a traction device 32, in turn, could be made of any durable material that resists wear and maintains a sharp point: for instance—tungsten carbide, stainless steel, or even spark-resistant copper for an application in which HTA is used around flammable materials (e.g., gasoline, oil, grease, chemicals, food service grease/oil, etc.). In the case of HTA 10 having traction devices 32, a weight of a wearer pushes traction devices 32 into a surface so that traction devices 32 grip and provide additional traction.

Turning to FIG. 6, an example traction device 32 is depicted. Traction device 32 includes a tungsten carbide spike 34 and a series of two interconnected, solid flanges 36, 38. As shown, large flange 38 is located towards a bottom of traction device 32. A bottom of flange 38 can be flat, similar to smooth surface 25 of gripping pad 14 (FIGS. 1*a*, 1*c*). Gap 40 separates and connects large flange 38 with small flange 36. A top of small flange 36 can also be flat, and forms a supporting surface for tungsten carbide spike 34, which can engage a slippery surface.

Tungsten carbide spike 34 is seen integrated into a center of traction device 32. Spike 34 can extend outwards from traction device 32 into a slippery surface to provide additional traction. Traction device 32 can be constructed using an injection molding technique which is similar to the injection molding processes that were described previously. Tungsten carbide spike 34 is first inserted into the mold and then hot, molten polymer is injected into the mold to surround the head of carbide spike 34. As the polymer hardens, tungsten carbide spike 34 is securely held in place in a center of traction device 32.

Turning now to FIG. 7, in order to use replaceable traction device 32 to provide additional traction or gripping power to HTA 10, a wearer inserts traction devices 32, small flange 36 first, into a receiving bore 24 from an upper surface of gripping pad 14. A material of gripping pad 14 then seats in gap 40 between large flange 38 and small flange 36. When seated, inner surfaces of large flange 38 and small flange 36 preferably contact flat surface 25 and flat surface 27, respectively, of gripping pad 14. Seating traction devices 32 in receiving bore 24 retains traction devices 32 in a stationary position with respect to gripping pad 14 but allows traction devices 32 to be removed for replacement or for safety.

A diameter of small flange 36 is appreciably larger than a diameter of receiving bore 24, and traction devices 32 may be inserted into receiving bore 24 based on the fact that gripping pad 14 is composed of an elastic material, as was indicated above. Without an appropriate amount of elasticity in a material of gripping pad 14, it would become impossible to easily maneuver small flange 36 through receiving bore 24 in order to seat traction devices 32.

Similarly, a diameter of large flange 38 is appreciably larger than a diameter of small flange 36, making it difficult to push or pull large flange 38 through receiving bore 24. In fact, there is little danger that traction device 32 may accidentally become unseated because of large flange 38 being pushed through gripping pad 14 due to a relative size disparity between a diameter of large flange 38 and a diameter of receiving bore 24.

Still referring to FIG. 7, gripping pad 14 advantageously includes a raised ring 41 that encircles and extends above circular-shaped smooth areas 27. Preferably, a height of raised rings 41 above smooth areas 27 is greater than a thickness of small flange 36. Since a top surface of small flanges 36 are below a top surface of raised rings 41 when traction devices 32 are seated in bores 24, raised rings 41 can cushion or protect small flanges 36 from rough and abrasive surfaces, and thereby increase a durability of traction devices 32.

Traction devices 32 may also include a hard plastic apparatus or a non-slip material such as a fibrous polyvinylchloride (PVC) loop material or similar material for enhancing traction in a particular situation, such as oily surfaces, tile surfaces, or hazardous surfaces such as caustic or similar surfaces. In other words, instead of or in addition to spike 34, traction device 32 may include traction-enhancing anti-slip materials on a lower surface of small flange 36.

Traction devices 32 may also include anti-shock and/or anti-fatigue materials that are designed to absorb shock and/or reduce fatigue when standing, walking, or running. In other words, instead of or in addition to spike 34, traction device 32 may advantageously incorporate an anti-shock material. Since gripping pad 14 is capable of holding five traction devices 32, it is conceivable that a wearer of HTA 10 could select from among several different types of traction devices 32 to fine-tune the particular traction and/or shock-absorption characteristics of HTA 10.

As indicated above, gripping pad 14 of HTA 10 can have removable traction devices 32 that help the wearer have grip and traction on a slippery surface. A weight of a wearer pushes traction devices 32 into a slippery surface so that traction devices bite into the slippery surface. Traction devices 32 need not be arranged in every available receiving bore 24 of gripping pad 14 in order to provide the wearer grip and traction on a slippery surface. Traction devices 32 can be arranged so that a heel of a foot pushes traction devices 32 into a surface while walking. Traction devices 32 are also engaged, for instance, when a person leans far back while pulling a rope tied to a heavy object.

Traction devices 32 can be readily removed from HTA 10 for use on surfaces that might be damaged by traction devices 32. Readily removing traction devices 32 facilitates replacement of worn traction devices 32, and is a safety feature that, for instance, can allow a user to be freed when a traction device 32 is inadvertently wedged in a crevice in a rigid surface.

As explained above, HTA 10 has built-in gripping features (e.g., ridges 28) in addition to replaceable traction devices 32. A user may wear HTA 10 without traction devices 32 and enjoy greatly increased traction, although maximum traction on ice, snow, or other slippery surfaces is achieved with use of traction devices such as replaceable traction devices 32. Removing traction devices 32 can be particularly useful when HTA 10 is worn indoors as many household surfaces could be damaged by spikes or other sharp traction devices 32.

Figure 8:
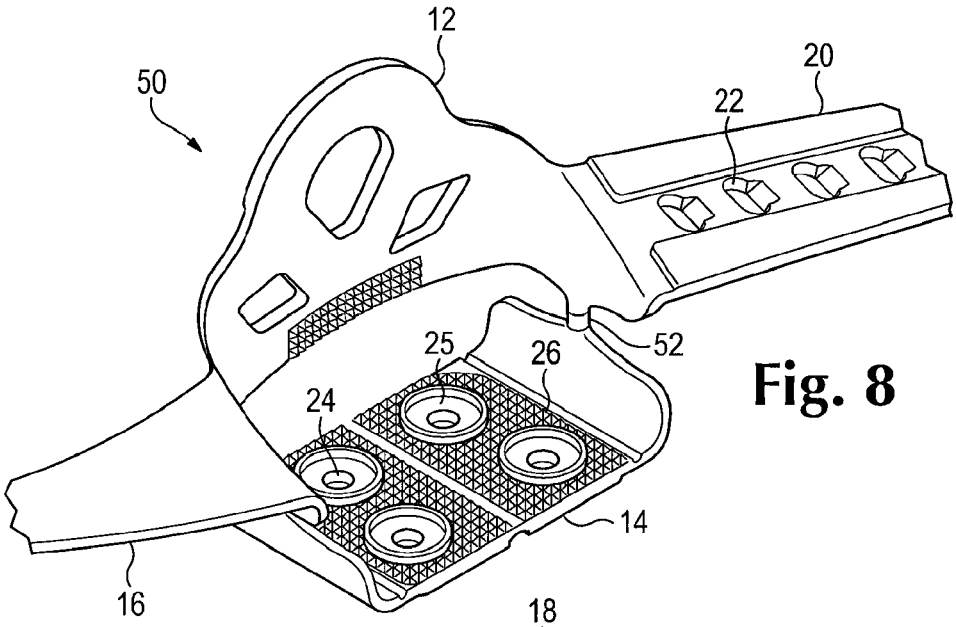
FIG. 8 is a perspective view diagram illustrating a portion of a HTA having a reversible gripping pad in accordance with another example embodiment.

FIG. 8 is a perspective diagram illustrating a portion of a HTA 50 having a reversible gripping pad 14 according to another example embodiment. HTA 50 shares many of the same features as HTA 10, features which were described above and illustrated in FIGS. 1*a*-1*d*. Thus, the following description of HTA 50 may refer to elements that are not shown in FIG. 8, but which are nevertheless still illustrated in FIGS. 1*a*-1*b*. In particular, the first and second straps 16, of HTA 50 are only partially illustrated in FIG. 8, but they are substantially the same as first and second straps 16, of FIGS. 1*a*-1*d*.

Referring to FIG. 8, a material of HTA 50 can be a durable elastic material that is tough, light-weight and flexible even in temperatures below 0° F. The term "elastic material" as described includes natural and synthetic polymers, including rubbers and reinforced rubbers, and other suitable materials. HTA 50 can be constructed using amorphous and crystalline thermoplastic resins. HTA 50 can be constructed using an injection molding process where hot, molten polymer is injected into a cold mold. A screw apparatus can be used to inject the polymer into the mold. After HTA 50 cools and hardens, the mold is opened and HTA 50 is ejected from the mold. Any resulting flashing is then removed from HTA 50. HTA 50 can be constructed by using an injection molding technique that extrudes material over an existing core plate in the mold to provide a unitary construction. In alternative embodiments, it is contemplated that HTA 50 could be manufactured using a compression molding process, a die-cutting process, a stamping process, or a water jet cutting process.

A material of HTA 50 can be formulated to allow for a certain amount of stretch, while maintaining durability and light weight. By allowing for stretch, a relatively small number of HTA sizes can be provided to accommodate a relatively larger number of shoe sizes. A small/medium size HTA 50 can easily accommodate a range of shoe sizes from small women's shoes to medium sized men's shoes. Similarly, a large/extra large size HTA 50 can easily accommodate a range of shoe sizes from medium sized men's shoes to much larger sized men's shoes. Essentially, two sizes of HTA 50 can be constructed to cover the broad range of both men's and women's shoe sizes.

HTA 50 includes a contoured heel cradle or heel cup 12 and a gripping pad 14. Heel cup 12 can be configured to have a concave surface that is shaped to approximately correspond to an outer contour of a heel portion of a human foot or an item of footwear, while gripping pad 14 can be configured to have a flat surface that is shaped to approximately correspond to an underside of a heel portion of a human foot or an item of footwear. Therefore, a concavity formed by heel cup 12 and gripping pad 14 can closely correspond to an overall shape of an outer contour of a heel portion of a human foot or an item of footwear.

As illustrated, gripping pad 14 is designed in a substantially square or rectangular shape. Alternatively, a shape of gripping pad 14 may be substantially circular, oval, ring, or egg shaped to more closely approximate a surface of a heel portion of a shoe. For example, a smaller, circular gripping pad may be more appropriate for a woman's dress shoe than a rectangular shape. In some embodiments gripping pad 14 can incorporate a material that reduces shock and that is also designed to improve anti-fatigue properties when standing, walking, or running.

HTA 50 further includes a first strap 16 having a proximal end that is attached to contoured heel cup 12 at a first location above a junction between contoured heel cup 12 and gripping pad 14. First strap 16 further includes a hook 18 disposed at a distal end of first strap 16.

HTA 50 further includes a second strap 20 having a proximal end that is attached to contoured heel cup 12 at a second location above another junction between contoured heel cup 12 and gripping pad 14. Second strap 20 further includes a series of holes 22 that are disposed uniformly along a length of second strap 20.

Heel cup 12, gripping pad 14, first strap 16, and second strap 20 can have a certain amount of associated elasticity. For example, first strap 16 and second strap 20 can be stretched by applying tension. Upon release of tension, first and second straps 16, 20 can return to their original shape.

As a result of the elasticity of first strap 16 and second strap 20 that was described above, first strap 16 and/or second strap 20 can be stretched so that hook 18, which is disposed at a distal end of first strap 16, can be inserted into a desired hole 22 in second strap 20, similar to the process that was described above with reference to FIGS. 2*a*-2*c*. The action of stretching first and second straps 16, 20 is typically, but not always, performed by a person who is wearing shoe 30 and is attempting to fasten HTA 50 around a heel 31 of shoe 30.

Securing hook 18 into a desired hole 22 of second strap 20 while first strap 16 and/or second strap 20 are extended prevents first strap 16 and/or second strap 20 from returning to their original shape, and thus provides tension that securely holds HTA 50 in place over a heel portion of shoe 30. Once HTA 50 is securely fastened to a heel of shoe 30, a wearer can feel more confident when engaged in winter activities, such as walking quickly on a snowy or icy sidewalk.

HTA 50 further includes a number of bores 24 that penetrate through a thickness of gripping pad 14 in desired locations. Bores 24 have a circular shape. Other embodiments may have fewer bores or more bores, which may be arranged in any desired pattern. Bores 24 are designed to retain replaceable traction aiding devices (e.g., spikes), further increasing traction and grip provided by HTA 50.

HTA 50 further includes smooth areas 25 that are disposed on an upper surface of gripping pad 14. Each smooth area 25 has a circular shape and is preferably, but not necessarily, disposed such that a bore 24 is located at a center of each smooth area 25.

HTA 50 further includes a textured area 26 that is disposed on an upper surface of gripping pad 14. Smooth areas 25 are disposed within textured area 26. Textured area 26 is a region on an upper surface of gripping pad 14 that has been provided a roughened or textured surface. Textured area 26 is adapted to contact an underside of a human heel or an underside of a heel on an item of footwear in order to help prevent slipping from occurring between gripping pad 14 and an underside of a human heel or an underside of a heel on an item of footwear. In some embodiments, textured area 26 of gripping pad 14 may be formed by creating corresponding textured areas in a surface of a mold that is used to form HTA 10.

Although not shown in FIG. 8, HTA 50 further includes raised rings 41 and smooth areas 27 that are disposed on a lower surface of gripping pad 14, like what is illustrated for HTA 10 in FIGS. 1*b*, 1*d* and 7. Each smooth area 27 has a circular shape and is preferably, but not necessarily, disposed such that a bore 24 is located at a center of each smooth area 27.

Although not shown in FIG. 8, like HTA 10 of FIGS. 1*b* and 1*d*, HTA 50 further includes traction aiding elements, such as ridges 28, which are also disposed on a lower surface of gripping pad 14. Smooth areas 27 are surrounded by ridges 28. Ridges 28 protrude from a lower surface of gripping pad 14, and are arranged in multiple rows across a length of gripping pad 14. Each row of ridges 28 is arranged such that each ridge 28 in a row "points" in the same direction. Rows of ridges 28 are further arranged such that ridges 28 in adjacent rows "point" in opposite directions. Rows of ridges 28 are further arranged such that each row of ridges 28 has a saw-tooth profile in a direction taken along a length of each row of ridges 28.

An arrangement of ridges 28, like the arrangement shown in FIGS. 1*b* and 1*d*, provides increased traction and surefootedness to a person wearing HTA 50 on a foot or on an item of footwear. Like textured areas 26 on an upper surface of gripping pad 14, ridges 28 may be formed by creating corresponding depressions in a surface of a mold that is used to form HTA 50.

In other example embodiments, traction aiding elements may be shaped differently, e.g., ridges 28 may be shaped as closed geometric figures such as a circles, ovals, squares, rectangles, trapezoids, triangles, hexagons, etc. In still other example embodiments, traction aiding elements such as pillars or spikes may be used in addition to or instead of ridges 28.

In still other example embodiments, gripping pad 14 of HTA 50 may additionally include other traction aiding elements such as one or more traction devices 32, which were described above with reference to FIG. 6. As was explained above, each traction device 32 includes a tungsten carbide spike 34 and is configured to be placed in a corresponding receiving bore 24 of gripping pad 14.

An important feature of HTA 50 are the pillar-shaped portions, or simply pillars 52, that join the contoured heel cup 12 to the gripping pad 14. Preferably, only one pillar 52 connects each side of gripping pad 14 to contoured heel cup 12. Preferably, but not necessarily, pillars 52 are disposed on the sides of gripping pad 14, approximately midway between a front edge and back edge of gripping pad 14.

A material of HTA 50 preferably has a preselected amount of elasticity and flexibility. An elasticity of HTA 50 advantageously allows a wearer of HTA 50 to selectively choose which surface of gripping pad 14 is to make contact with the ground when the HTA 50 is worn by placing pillars 52 in either a twisted or un-twisted state. Pillars 52 preferably have sufficient elasticity such that gripping pad 14 can be rotated through an angle of at least 180 degrees relative to an axis passing through pillars 52, thereby causing pillars 52 to twist. Rotating gripping pad 14 by 180 degrees relative to an axis passing through pillars 52 has the effect of exchanging a top surface of gripping pad 14 for a bottom surface of gripping pad 14, and vice versa.

Figure 9:
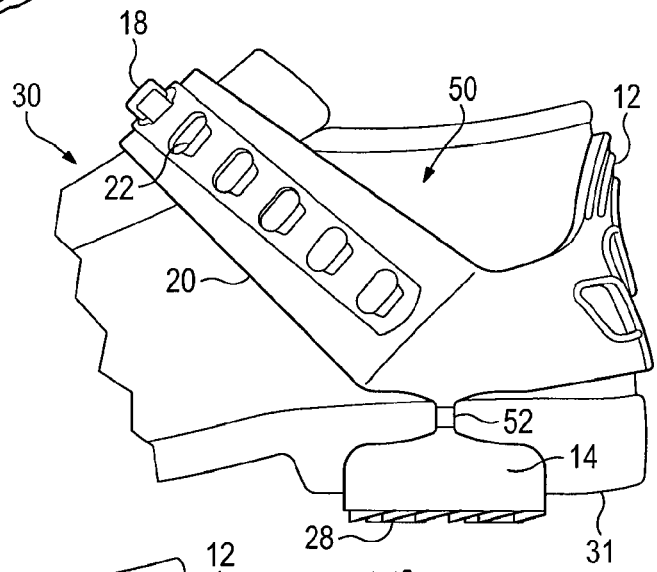
FIG. 9 is a diagram illustrating the HTA of FIG. 8 secured around the heel of a shoe, with the reversible gripping pad in a first position.
Figure 10:
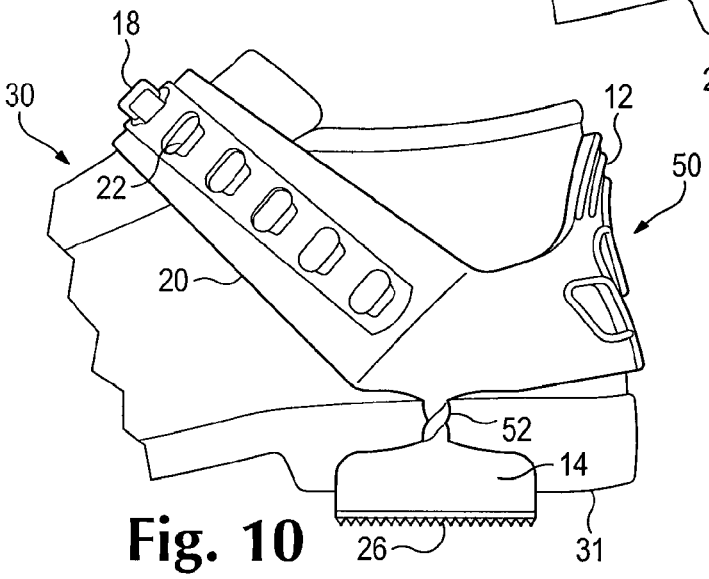
FIG. 10 is a diagram illustrating the reversible gripping pad of FIG. 8 secured around the heel of a shoe, with the reversible gripping pad in a second position.

This capability of HTA 50 is illustrated with greater detail in FIGS. 9 and 10. FIG. 9 illustrates HTA 50 being worn on a shoe 30 with pillars 52 disposed in a natural, un-twisted state. FIG. 8 also illustrates the pillars 52 disposed in a natural, un-twisted state. As shown in FIGS. 8 and 9, one surface of gripping pad 14 is disposed facing downwardly, and another, opposite surface of gripping pad 14 is disposed facing upwardly.

On the other hand, FIG. 10 illustrates HTA 50 after a twist has been placed in flexible pillars 52 in order that an arrangement of gripping pad 14 is flipped or inverted relative to an arrangement of gripping pad 14 as shown in FIG. 9. That is, a top surface of gripping pad 14 in FIG. 9 becomes a bottom surface of gripping pad 14 in FIG. 10, and vice versa. In FIG. 9, ridges 28 face downward, while in FIG. 10, textured area 26 faces downward.

Placing a twist in flexible pillars 52 of HTA 50 is relatively simple; all that is required is for the wearer to rotate the gripping pad 14 forward or backward through approximately 180 degrees of rotation prior to placing the HTA 50 on the shoe 30. Again, this rotation of gripping pad 14 is made possible due to the advantageous use of pillars 52, which have a desired amount of elasticity and flexibility.

In some embodiments, it is contemplated that pillars 52 have sufficient elasticity or flexibility to allow gripping pad 14 to be pulled back and worn at the back of the heel of shoe 30, which advantageously allows a gripping surface of gripping pad 14 and/or traction devices 32 to be placed in a position where walking surfaces such as tile, wood floors, or any surface in general which the gripping surface and/or traction devices 32 may come into contact with are protected from being marred and/or scratched.

A diameter of pillars 52 can be selected to achieve a balance between durability and ease of use. On one hand, pillars 52 should be thick enough to withstand many twisting and untwisting cycles without breaking. On the other hand, pillars 52 should not be so thick as to make it too difficult to rotate gripping pad 14 through approximately 180 degrees of rotation. Pillars 52 are also designed to allow rotation of gripping pad 14 through at least 180 degrees of rotation without significant deformation of heel cup 12. Conventional HTAs do not possess these capabilities.

As described above, HTA 50 is capable of interchanging surfaces of gripping pad 14 due to a flexible nature of pillars 52 that are used to join heel cup 12 to gripping pad 14. For convenience, the ability of some example embodiments to interchange surfaces of gripping pad 14 may be referred to as reversibility, and gripping pad 14 may be described as being reversible.

In alternative embodiments, it is contemplated that each side of gripping pad 14 can have a different texture or tread pattern that is adapted or designed for a different purpose. For example, a texture or tread pattern disposed on a first surface of gripping pad 14 may have traction aiding elements such as channels that are designed to prevent hydro-planing on smooth wet surfaces, similar to channels that are found on contact surfaces of an automobile tire. As another example, a texture or tread pattern disposed on a second surface of gripping pad 14 opposite the first surface may have traction aiding elements such as large protrusions or ridges that are designed to improve traction on snow-covered surfaces. Those of skill in the art will recognize that numerous other texture or tread pattern combinations can be implemented on opposite surfaces of gripping pad 14. In short, opposite surfaces of gripping pad 14 may include any number or type of traction aiding elements, and the traction aiding elements can have any desired size or shape. For example, traction aiding elements may be shaped differently, e.g., shaped as closed geometric figures such as a circles, ovals, squares, rectangles, trapezoids, triangles, hexagons, etc.

If gripping pad HTA 50 was modified to have water channels on one side of gripping pad 14 and ridges for increased traction on snow on another side of gripping pad 14 as was described in the paragraph immediately above, HTA 50 could provide increased traction that was specifically tailored to both wet and snowy surfaces, depending on the reversibility state of gripping pad 14. This is an advantage over traction aids that are not reversible because those traction aids must utilize a single texture or tread pattern that is usually a compromise designed to provide acceptable traction in all possible conditions. In contrast, HTA 50 can provide excellent traction tailored for several different conditions because of its reversibility.

In alternative embodiments, it is also contemplated that gripping pad 14 of HTA 50 can be covered with one or more additional layers of material that are different than the material used to form gripping pad 14. Preferably, these one or more additional layers of material are also designed to provide increased traction in different conditions. For example, felt can be used to cover the soles of fishermen's waders because it provides increased traction on submerged, algae-covered rocks. Thus, in some embodiments, a layer of felt could be applied to a surface of reversible gripping pad 14.

In alternative embodiments, it is contemplated that one surface of gripping pad 14 of HTA 50 can be one that is specifically designed to prevent marking, scratching, or scuffing of smooth surfaces. Thus, with such embodiments, HTA 50 can be worn indoors without inconveniently requiring a wearer to remove HTA 50 from her shoe.

Referring again to FIGS. 9 and 10, first and second straps 16, 20 of HTA 50 do not extend past a vamp portion of shoe 30, and gripping pad 14 does not extend forward from a heel 31 of shoe 30, although this may not hold true for all example embodiments. Limiting gripping pad 14 to heel 31 of shoe 30 enables a person wearing HTA 50 to enjoy the benefits of added traction by adjusting the stride or gait that is used.

For example, a runner attempting to run on a jogging path that possessed patchy areas of ice and snow could easily run on balls of her feet if she encountered a clear or dry patch without having to place gripping pad 14 in contact with the ground. If, however, a snowy or icy patch was encountered the runner could alter her stride slightly to cause her heel to strike the ground, causing gripping pad 14 and associated ridges 28 and/or traction devices 32 to engage the slippery surface. The runner may also choose to slow down and use a walking gait, which would also result in gripping pad 14 contacting the ground.

A process of securing HTA 50 to shoe 30 is the same as what was described above for securing HTA 10 to shoe 30, which was made with reference to FIGS. 2*a*-2*c*. Like HTA 10, a bulk of stretch that occurs in HTA 50 is performed by first and second straps 16, 20. First and second straps 16, 20 stretch appropriately to accommodate the respective size of shoe 30, while a basic size and form of gripping pad 14 remains substantially unchanged. First strap 16 and second strap 20 appropriately stretch on both left and right sides to ensure that gripping pad 14 is centered properly. Because of the elasticity and deformability associated with first strap 16 and second strap 20, HTA 50 can take on a virtually flat, two-dimensional form when not in use. Having a virtually flat form is attractive for storage and packaging purposes, as a number of stored HTAs 50 can be placed in a relatively small storage space, and individual HTAs 50 can utilize relatively thin packaging.

HTA 50 can have greater thickness in critical areas. Other anti-slip overshoes have a thickness that is essentially uniform throughout. Having a uniform thickness may simplify mass production of conventional overshoes, but the durability of such overshoes is compromised by doing so. A longevity of HTA 50 can be improved by adding extra material thickness at key areas. For instance, gripping pad 14 can have thicker material than heel cup 12. In addition, areas around traction devices 32 can be reinforced with additional material.

The contoured design of heel cup 12 and gripping pad 14 in HTA 50 allows for a proper amount of stretch and corresponding fitment in an appropriate direction, either from side to side, or from front to back. As illustrated in FIGS. 9-10, a design of HTA 50 can be well-suited for use with a casual shoe 30. However, it is contemplated that HTA 50 may be, either with slight modifications or without, equally well-suited for any other type of footwear such as athletic shoes, dress shoes, boots, sandals, or even bare human feet.

Figure 11:
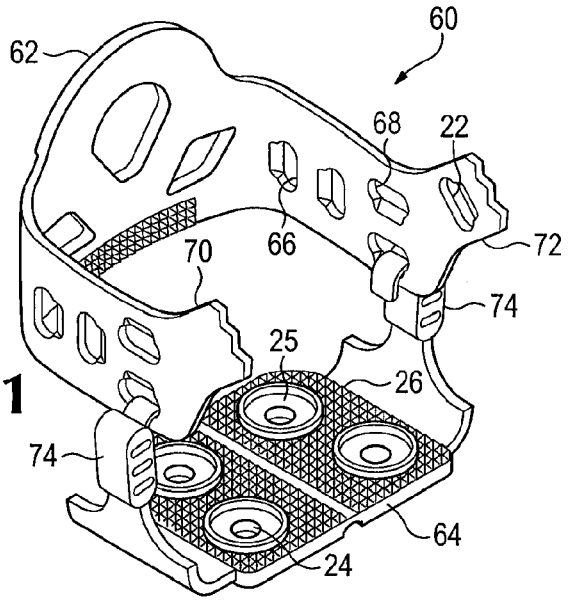
FIG. 11 is a perspective view diagram illustrating a portion of a HTA having a removable and reversible gripping pad in accordance with still another example embodiment.

FIG. 11 is a perspective diagram illustrating a portion of a HTA 60 according to another example embodiment. HTA 60 differs from HTA 10 and HTA 50 in several ways. Notably, compared to heel cup 12 of HTA 10 and HTA 50, heel cup 62 of HTA 60 includes vertical holes 66 and horizontal holes 68, the function of which will be described in further detail below. Another notable difference is that heel cup 62 and gripping pad 64 are not formed as one piece, and thus they may be manufactured separately. Another notable difference is that first and second straps 70, 72 of HTA 60 are narrower than first and second straps 16, 20 of HTA 10 and HTA 50. However, like second strap 16 of HTA 10 and HTA 50, second strap 72 of HTA 60 still possesses a series of holes 22 that are disposed uniformly along a length of second strap 72.

Referring to FIG. 11, a material of heel cup 62 and gripping pad 64 can be a durable elastic material that is tough, lightweight and flexible even in temperatures below 0° F. The term "elastic material" as described includes natural and synthetic polymers, including rubbers and reinforced rubbers, and other suitable materials. Heel cup 62 and gripping pad 64 can be constructed using amorphous and crystalline thermoplastic resins. Heel cup 62 and gripping pad 64 can be constructed using an injection molding process where hot, molten polymer is injected into a cold mold. A screw apparatus can be used to inject the polymer into the mold. After heel cup 62 and gripping pad 64 cool and harden, the mold is opened and heel cup 62 and gripping pad 64 are ejected from their molds. Any resulting flashing is then removed from heel cup 62 and gripping pad 64. Heel cup 62 and gripping pad 64 can be constructed by using an injection molding technique that extrudes material over an existing core plate in the mold to provide a unitary construction.

A material of heel cup 62 and gripping pad 64 can be formulated to allow for a certain amount of stretch, while maintaining durability and light weight. By allowing for stretch, a relatively small number of HTA sizes can be provided to accommodate a relatively larger number of shoe sizes. A small/medium size HTA 60 can easily accommodate a range of shoe sizes from small women's shoes to medium sized men's shoes. Similarly, a large/extra large size HTA 60 can easily accommodate a range of shoe sizes from medium sized men's shoes to much larger sized men's shoes. Essentially, two sizes of HTA 60 can be constructed to cover the broad range of both men's and women's shoe sizes.

HTA 60 includes a contoured heel cradle or heel cup 62 and a gripping pad 64. Heel cup 62 can be configured to have a concave surface that is shaped to approximately correspond to an outer contour of a heel portion of a human foot or an item of footwear, while gripping pad 64 can be configured to have a flat surface that is shaped to approximately correspond to an underside of a heel portion of a human foot or an item of footwear. Therefore, a concavity formed by heel cup 62 and gripping pad 64 can closely correspond to an overall shape of an outer contour of a heel portion of a human foot or an item of footwear.

As illustrated, gripping pad 64 is designed in a substantially square or rectangular shape. Alternatively, a shape of gripping pad 14 may be substantially circular, oval, ring, or egg shaped to more closely approximate a surface of a heel portion of a shoe. For example, a smaller, circular gripping pad may be more appropriate for a woman's dress shoe than a rectangular shape. In some embodiments gripping pad 64 can incorporate a material that reduces shock and that is also designed to improve anti-fatigue properties when standing, walking, or running.

Figure 12:
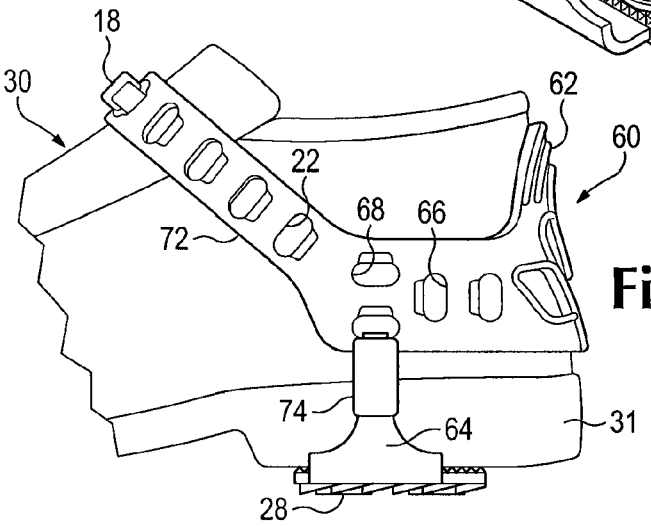
FIG. 12 is a diagram illustrating the HTA of FIG. 11 secured around the heel of a shoe, with the gripping pad in a first position.

As shown in FIG. 11, gripping pad 64 includes two hooks 74, where hooks 74 are disposed at opposite edges of gripping pad 64. As shown in FIGS. 11 and 12, hooks 74 are used to secure gripping pad 64 to heel cup 62 by placing hooks 74 in horizontal holes 68.

Heel cup 62 of HTA 60 further includes a first strap 70 having a proximal end that is attached to contoured heel cup 62 at a first location approximately above a junction between contoured heel cup 62 and gripping pad 64. First strap 70 further includes a hook 18 disposed at a distal end of first strap 70.

Heel cup 62 of HTA 60 further includes a second strap 72 having a proximal end that is attached to contoured heel cup 62 at a second location approximately above another junction between contoured heel cup 62 and gripping pad 64. Second strap 72 further includes a series of holes 22 that are disposed uniformly along a length of second strap 72.

Heel cup 62, gripping pad 64, first strap 70, and second strap 72 can have a certain amount of associated elasticity. For example, first strap 70 and second strap 72 can be stretched by applying tension. Upon release of tension, first and second straps 70, 72 can return to their original shape.

As a result of the elasticity of first strap 70 and second strap 72 that was described above, first strap 70 and/or second strap 72 can be stretched so that hook 18, which is disposed at a distal end of first strap 70, can be inserted into a desired hole 22 in second strap 72, similar to the process that was described above with reference to FIGS. 2*a*-2*c*. The action of stretching first and second straps 70, 72 is typically, but not always, performed by a person who is wearing shoe 30 and is attempting to fasten HTA 60 around a heel 31 of shoe 30.

Securing hook 18 into a desired hole 22 of second strap 72 while first strap 70 and/or second strap 72 are extended prevents first strap 70 and/or second strap 72 from returning to their original shape, and thus provides tension that securely holds HTA 60 in place over a heel portion of shoe 30. Once HTA 60 is securely fastened to a heel 31 of shoe 30, a wearer can feel more confident when engaged in winter activities, such as walking quickly on a snowy or icy sidewalk.

HTA 60 further includes a number of bores 24 that penetrate through a thickness of gripping pad 64 in desired locations. Bores 24 have a circular shape. Other embodiments may have fewer bores or more bores, which may be arranged in any desired pattern. Bores 24 are designed to retain replaceable traction devices (such as traction devices 32), further increasing traction and grip provided by HTA 60.

HTA 60 further includes smooth areas 25 that are disposed on an upper surface of gripping pad 64. Each smooth area 25 has a circular shape and is preferably, but not necessarily, disposed such that a bore 24 is located at a center of each smooth area 25.

HTA 60 further includes a textured area 26 that is disposed on an upper surface of gripping pad 64. Smooth areas 25 are disposed within textured area 26. Textured area 26 is a region on an upper surface of gripping pad 64 that has been provided a roughened or textured surface. Textured area 26 is adapted to contact an underside of a human heel or an underside of a heel on an item of footwear in order to help prevent slipping from occurring between gripping pad 64 and an underside of a human heel or an underside of a heel on an item of footwear. In some embodiments, textured area 26 of gripping pad 64 may be formed by creating corresponding textured areas in a surface of a mold that is used to form HTA 60.

Although not shown in FIG. 11, HTA 60 further includes raised rings 41 and smooth areas 27 that are disposed on a lower surface of gripping pad 64, like what is illustrated for HTA 10 in FIGS. 1*b*, 1*d*, and 7. Each smooth area 27 has a circular shape and is preferably, but not necessarily, disposed such that a bore 24 is located at a center of each smooth area 27.

Although not shown in FIG. 11, like HTA 10 of FIGS. 1*b* and 1*d*, HTA 60 further includes traction aiding elements, such as ridges 28, which are also disposed on a lower surface of gripping pad 64. Smooth areas 27 are surrounded by ridges 28. Ridges 28 protrude from a lower surface of gripping pad 64, and are arranged in multiple rows across a length of gripping pad 64. Each row of ridges 28 is arranged such that each ridge 28 in a row "points" in the same direction. Rows of ridges 28 are further arranged such that ridges 28 in adjacent rows "point" in opposite directions. Rows of ridges 28 are further arranged such that each row of ridges 28 has a saw-tooth profile in a direction taken along a length of each row of ridges 28.

An arrangement of ridges 28, like the arrangement shown in FIGS. 1*b* and 1*d*, provides increased traction and surefootedness to a person wearing HTA 60 on a foot or on an item of footwear. Like textured areas 26 on an upper surface of gripping pad 64, ridges 28 may be formed by creating corresponding depressions in a surface of a mold used to form HTA 60.

In other example embodiments, traction aiding elements may be shaped differently, e.g., ridges 28 may be shaped as closed geometric figures such as a circles, ovals, squares, rectangles, trapezoids, triangles, hexagons, etc. In still other example embodiments, traction aiding elements such as pillars or spikes may be used in addition to or instead of ridges 28.

In still other example embodiments, gripping pad 64 of HTA 60 may additionally include other traction aiding elements such as one or more traction devices 32, which were described above with reference to FIG. 6. Each traction device 32 includes a tungsten carbide spike 34 and is configured to be placed in a corresponding receiving bore 24 of gripping pad 64.

An important feature of HTA 60 are hooks 74 that join the contoured heel cup 62 to the gripping pad 64 by attaching to horizontal holes 68. Similar to what pillars 52 provide for HTA 50, hooks 74 of HTA 60 also give gripping pad 64 reversibility. Gripping pad 64 is detachably affixed to heel cup 62 by hooks 74. Thus, gripping pad 64 may be reversed relatively easily by removing hooks 74 from horizontal holes 68, rotating gripping pad 64 forward or backward by approximately 180 degrees, and reattaching hooks 74 to one of the horizontal holes 68.

Another important feature of HTA 60 is the presence of vertical holes 66, which are included in heel cup 62. Vertical holes 66 are substantially the same size and shape as horizontal holes 68 and holes 22 that are arranged on the second strap 72, although vertical holes 66 are rotated by approximately ninety degrees relative to horizontal holes 68.

Figure 13:
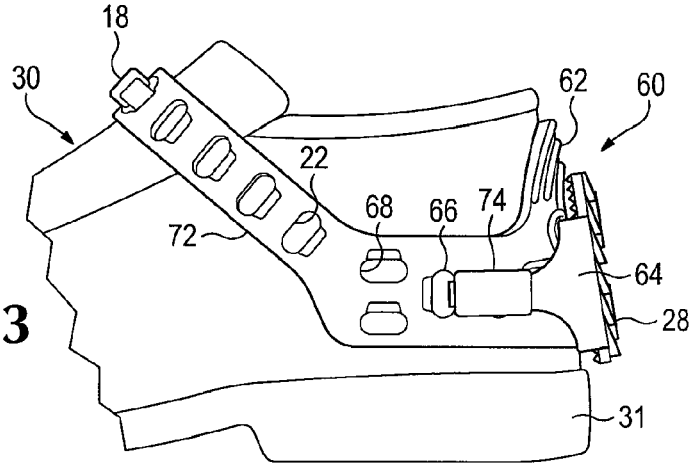
FIG. 13 is a diagram illustrating the reversible gripping pad of FIG. 11 secured around the heel of a shoe, with the reversible gripping pad in a second position.

As shown in FIG. 13, gripping pad 64 may be worn across a back of heel 31 by removing hooks 74 from horizontal holes 68 and then placing the hooks 74 in vertical holes 66, such that gripping pad 64 stretches across a back of heel 31. Wearing gripping pad 64 across a back of heel 31 as shown in FIG. 13 is advantageous because it provides a convenient way of securing gripping pad 64 when the additional traction provided by gripping pad 64 is no longer required. This may occur, for example, if the wearer enters a building and does not wish to damage interior floors with traction aiding elements such as traction devices 32 (FIG. 6).

In alternative embodiments, it is contemplated that each side of gripping pad 64 can have a different texture or tread pattern that is adapted or designed for a different purpose. For example, a texture or tread pattern disposed on a first surface of gripping pad 64 may have traction aiding elements such as channels that are designed to prevent hydro-planing on smooth wet surfaces, similar to channels that are found on contact surfaces of an automobile tire. As another example, a texture or tread pattern disposed on a second surface of gripping pad 64 opposite the first surface may have traction aiding elements such as large protrusions or ridges that are designed to improve traction on snow-covered surfaces. Those of skill in the art will recognize that numerous other texture or tread pattern combinations can be implemented on opposite surfaces of gripping pad 64. In short, opposite surfaces of gripping pad 64 may include any number or type of traction aiding elements, and the traction aiding elements can have any desired size or shape. For example, traction aiding elements may be shaped differently, e.g., shaped as closed geometric figures such as a circles, ovals, squares, rectangles, trapezoids, triangles, hexagons, etc.

If gripping pad HTA 60 was modified to have water channels on one side of gripping pad 64 and ridges for increased traction on snow on another side of gripping pad 64 as was described in the paragraph immediately above, HTA 60 could provide increased traction that was specifically tailored to both wet and snowy surfaces, depending on the reversibility state of gripping pad 64. This is an advantage over traction aids that are not reversible because those traction aids must utilize a single texture or tread pattern that is usually a compromise designed to provide acceptable traction in all possible conditions. In contrast, HTA 60 can provide excellent traction tailored for several different conditions because of its reversibility.

In alternative embodiments, it is also contemplated that gripping pad 64 of HTA 60 can be covered with one or more additional layers of material that are different than the material used to form gripping pad 64. Preferably, these one or more additional layers of material are also designed to provide increased traction in different conditions. For example, felt is often used to cover the soles of fishermen's waders because it provides increased traction on submerged, algae-covered rocks. Thus, in some embodiments, a layer of felt could be applied to a surface of reversible gripping pad 64.

Referring again to FIGS. 12 and 13, first and second straps 70, 72 of HTA 60 do not extend past a vamp portion of shoe 30, and gripping pad 64 does not extend forward from a heel 31 of shoe 30, although this may not hold true for all embodiments. Limiting gripping pad 64 to heel 31 of shoe 30 enables a person wearing HTA 60 to enjoy the benefits of added traction by adjusting the stride or gait that is used.

For example, a runner attempting to run on a jogging path that possessed patchy areas of ice and snow could easily run on balls of her feet if she encountered a clear or dry patch without having to place gripping pad 64 in contact with the ground. If, however, a snowy or icy patch was encountered the runner could alter her stride slightly to cause her heel to strike the ground, causing gripping pad 64 and associated ridges 28 and/or traction devices 32 to engage the slippery surface. The runner may also choose to slow down and use a walking gait, which would also result in gripping pad 64 contacting the ground.

A process of securing HTA 60 to shoe 30 is the same as a process for securing HTA 10 to shoe 30, which was described above with reference to FIGS. 2*a*-2*c*. Like HTA 10, a bulk of stretch that occurs in HTA 60 is performed by first and second straps 70, 72. First and second straps 70, 72 stretch appropriately to accommodate the respective size of shoe 30, while a basic size and form of gripping pad 64 remain substantially unchanged. First strap 70 and second strap 72 appropriately stretch on both left and right sides to ensure that gripping pad 64 is centered properly. Because of the elasticity and deformability associated with first strap 70 and second strap 72, HTA 60 can take on a virtually flat, two-dimensional form when not in use. Having a virtually flat form is attractive for storage and packaging purposes, as a number of stored HTAs 60 can be placed in a relatively small storage space, and individual HTAs 60 can utilize relatively thin packaging.

HTA 60 can have greater thickness in critical areas. Other anti-slip overshoes have a thickness that is essentially uniform throughout. Having a uniform thickness may simplify mass production of prior art overshoes, but the durability of prior art overshoes are compromised. The longevity of HTA 60 can be improved by adding extra material thickness at key areas. For instance, gripping pad 64 can have thicker material than heel cup 62. In addition, areas around traction devices 32 can be reinforced with additional material.

The contoured design of heel cup 62 and gripping pad 64 in HTA 60 allows for a proper amount of stretch and corresponding fitment in an appropriate direction, either from side to side, or from front to back. As illustrated in FIGS. 9-10, a design of HTA 60 can be well-suited for use with a man's shoe 30. However, it is contemplated that HTA 60 may be, either with slight modifications or without, equally well-suited for other types of footwear such as athletic shoes, casual shoes, boots, sandals, or even bare human feet.

While one or more embodiments of the present invention have been illustrated in detail, the skilled artisan will appreciate that modifications and adaptations to those embodiments may be made without departing from the scope of the present invention as set forth in the following claims.

What is claimed is:

1. A heel traction aid (HTA), comprising:

a gripping pad configured for attachment under a heel portion of a human foot or an item of footwear and including a receiving bore formed through the gripping pad;

a traction device disposed in the receiving bore of the gripping pad and including a spike formed on the traction device;

a heel cup including a first strap attached to the heel cup over a first edge of the gripping pad and a second strap attached to the heel cup over a second edge of the gripping pad opposite the first edge, wherein the heel cup, first strap, and second strap include a unitary construction;

a first pillar attached between the heel cup and first edge of the gripping pad; and a second pillar attached between the heel cup and second edge of the gripping pad, wherein the first pillar and second pillar are configured to allow the gripping pad to rotate relative to the heel cup.

2. The HTA of claim 1, further including:

a first hook disposed on the first pillar to attach the first pillar to the heel cup; and a second hook disposed on the second pillar to attach the second pillar to the heel cup.

3. The HTA of claim 1, wherein the traction device includes an anti-shock material.

4. The HTA of claim 1, wherein the gripping pad further includes a raised ring disposed around the receiving bore.

5. The HTA of claim 1, further including:

a first texture on a first surface of the gripping pad; and a second texture on a second surface of the gripping pad.

6. The HTA of claim 5, wherein the first texture includes a channel.

7. A heel traction aid (HTA) comprising:

a gripping pad configured for attachment under a heel portion of a human foot or an item of footwear;

a heel cup including a first strap attached to the heel cup and a second strap attached to the heel cup opposite the first strap, wherein the heel cup, first strap, and second strap include a unitary construction;

a first pillar attached between the heel cup and gripping pad; and a second pillar attached between the heel cup and gripping pad opposite the first pillar, wherein the first pillar and second pillar are configured to allow the gripping pad to rotate relative to the heel cup.

8. The HTA of claim 7, further including:

a first texture on a first surface of the gripping pad; and a second texture on a second surface of the gripping pad.

9. The HTA of claim 8, wherein the first texture includes a channel.

10. The HTA of claim 7, wherein the gripping pad includes an anti-shock material.

11. The HTA of claim 7, wherein the gripping pad includes a receiving bore formed through the gripping pad.

12. The HTA of claim 11, further including a traction device disposed in the receiving bore.

13. A heel traction aid (HTA) comprising:

a heel cup;

a gripping pad coupled to form a concavity with the heel cup;

a first pillar attached between the heel cup and gripping pad; and a second pillar attached between the heel cup and gripping pad opposite the first pillar, wherein the first pillar and second pillar are configured to allow the gripping pad to rotate relative to the heel cup.

14. The HTA of claim 13, further including:

a first texture on a first surface of the gripping pad; and a second texture on a second surface of the gripping pad.

15. The HTA of claim 14, wherein the first texture includes a channel.

16. The HTA of claim 13, further including a traction device disposed through the gripping pad.

17. The HTA of claim 16, wherein the traction device includes an anti-shock material.

18. The HTA of claim 16, further including a raised ring disposed around the traction device.

19. The HTA of claim 13, wherein the heel cup includes a first strap and a second strap having unitary construction with the heel cup.

20. The HTA of claim 13, wherein the gripping pad is configured for attachment under a heel portion of a human foot or an item of footwear without extending forward from the heel portion.

21. The HTA of claim 13, further including:

a first hook disposed on the first pillar to attach the first pillar to the heel cup; and a second hook disposed on the second pillar to attach the second pillar to the heel cup.

* * * * *